United States Patent [19]

Cox

[11] 4,101,129

[45] Jul. 18, 1978

[54] GAMING MACHINES

[75] Inventor: Calvin Howard Cox, Cotgrave, England

[73] Assignee: Bell-Fruit Manufacturing Company Limited, Nottingham, England

[21] Appl. No.: 677,291

[22] Filed: Apr. 15, 1976

[30] Foreign Application Priority Data

Apr. 17, 1975 [GB] United Kingdom ..... 15780/75

[51] Int. Cl.[2] ..... A63F 9/00

[52] U.S. Cl. ..... 273/143 R; 273/138 A

[58] Field of Search ..... 194/1 M, 1 N; 235/92 GA; 273/1 E, 138 A, 139, 143 R; 340/323 R

[56] References Cited

U.S. PATENT DOCUMENTS

| | | | |
|---|---|---|---|
| 3,606,337 | 9/1971 | Larsen et al. | 273/143 R |
| 3,770,269 | 11/1973 | Elder | 273/1 E |
| 3,834,712 | 9/1974 | Cox | 273/143 R |
| 3,889,956 | 6/1975 | Castle | 273/138 A |
| 3,918,716 | 11/1975 | Nonaka et al. | 273/138 A |

FOREIGN PATENT DOCUMENTS

| | | | |
|---|---|---|---|
| 1,178,302 | 1/1970 | United Kingdom | 273/138 A |
| 41,594 | 2/1971 | United Kingdom | 273/138 A |

*Primary Examiner*—Richard C. Pinkham
*Assistant Examiner*—Vance Y. Hum
*Attorney, Agent, or Firm*—Scrivener, Parker, Scrivener & Clarke

[57] ABSTRACT

In a gaming machine of the kind which selects a combination of symbols at random during each game and awards prizes when predetermined prize-winning combinations occur, a detector for detecting said prize-winning combinations of symbols comprising a first memory for storing information of each of a number of predetermined symbols which can occur in said selected combinations, a second memory storing information of each of a number of predetermined symbol occurence patterns which can occur in said selected combinations, a first set of comparators for comparing each of the symbols in a selected combination with each in turn of said predetermined symbols stored in said first memory so as to determine an occurrence pattern for each of said predetermined symbols, and a second set of comparators for comparing each determined occurrence pattern in turn with a number of predetermined occurrence patterns stored in said second memory which are associated with the predetermined symbol used for comparison in determining said occurrence pattern and which correspond to prize-winning combinations, the second set of comparators producing a coincidence signal to indicate a win when the determined occurrence pattern corresponds to a predetermined occurrence pattern. Thus each selected combination is analysed a plurality of times using a different combination of predetermined symbol and occurrence pattern each time so as to "look for" each possible prize-winning combination in turn.

22 Claims, 1 Drawing Figure

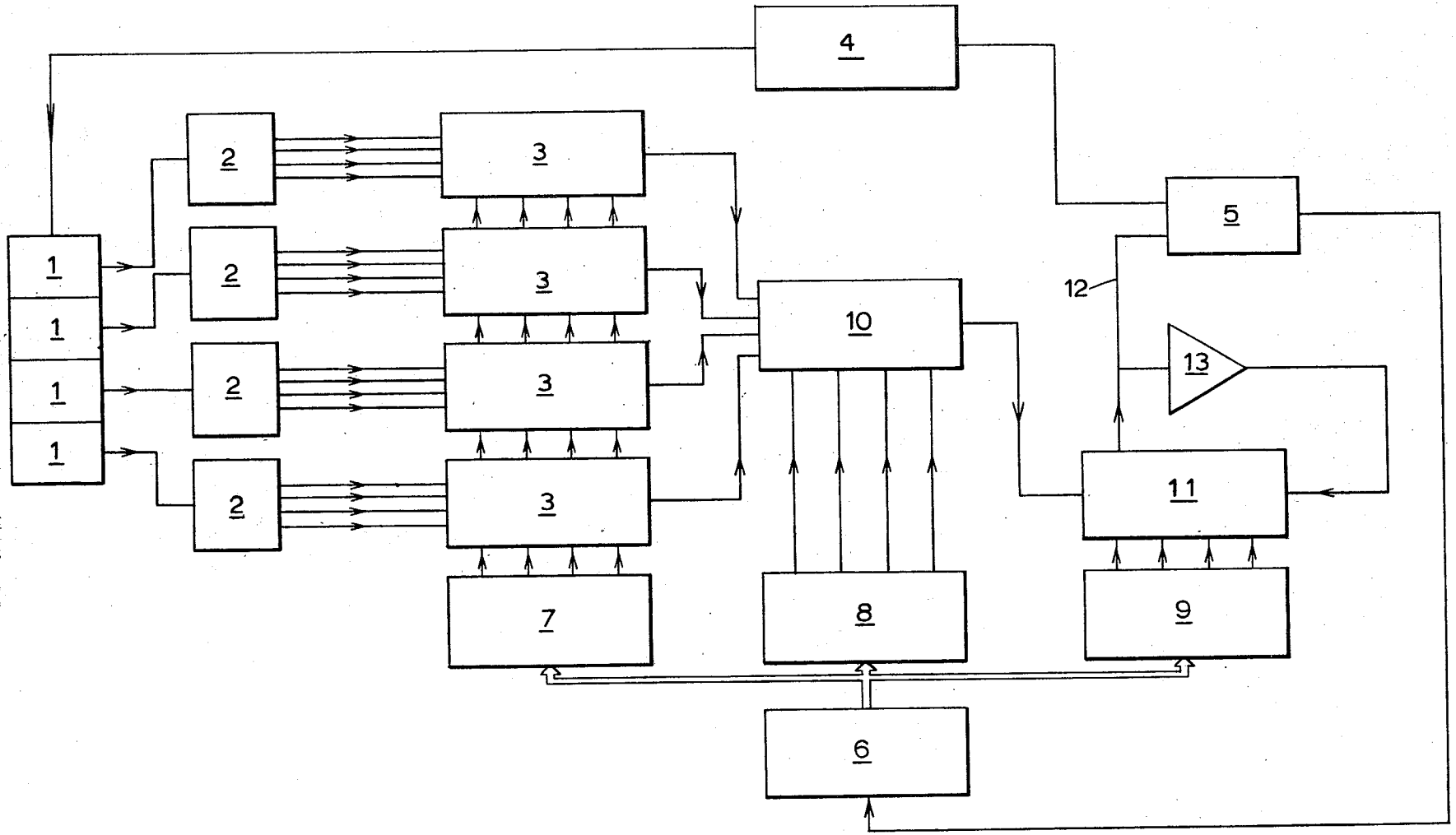
1
1
1
1
2
2
2
2
3
3
3
3
4
5
6
7
8
9
10
11
12
13

GAMING MACHINES

This invention relates to gaming machines of the kind which selects a combination of symbols at random during each game and awards prizes when predetermined prize-winning combinations occur. Commonly known gaming machines of this kind comprise a set of rotatably mounted reels or discs each of which carries symbols around its circumference and which, during a game, is spun and stopped at random at one of a plurality of possible stop positions in each of which it displays a corresponding symbol to a player through a window.

Detecting the occurrence of said predetermined prize-winning combinations has been achieved in reel type machines using detector means comprising rotary switches which rotate with the reels and control appropriate prize-winning circuits. Photoelectric detector means has also been provided in which the reels are provided with holes arranged to control the passage of light from a light source on one side of each reel to photoelectric cells on the other side of each reel. In one such machine, an arrangement of holes and cells is associated with each reel so that the cells produce a binary coded signal which is uniquely characteristic of the rest position of the reel. These coded signals are fed to logic circuitry which is adapted to produce an appropriate win signal for each combination of coded input signals corresponding to a prize-winning combination.

Both of these known detector means include circuitry which is especially designed to suit the possible prize-winning combinations and which becomes more complicated the greater the number of prize-winning combinations and the number of different prizes. An object of the present invention is to provide a gaming machine with detector means which is relatively simple in design and which can operate to detect any number of prize-winning combinations without the need for design modifications.

According to the present invention means for detecting prize-winning combinations of symbols in a gaming machine of the aforesaid kind comprises first comparison means for comparing each of the symbols in a selected combination with a chosen symbol so as to determine an occurrence pattern for said chosen symbol, and second comparison means which compares the determined occurrence pattern with one or more predetermined occurrence patterns which are associated with said chosen symbol and correspond to prize-winning combinations, the second comparison means producing a coincidence signal to indicate a win when the determined occurrence pattern corresponds to a predetermined prize-winning occurrence pattern, and the first and second comparison means carrying out their respective comparison operations for each of a number of chosen symbols in turn. Thus each selected combination is analysed a plurality of times using a different combination of chosen symbol and occurrence pattern each time so as to "look for" each possible prize-winning combination in turn.

Preferably, comparison of the symbols in the first comparison means is facilitated by ascribing a characteristic coded signal to each symbol. Corresponding coded signals are produced for each symbol in the selected combination and these are stored in corresponding symbol comparator units. A predetermined sequence of coded signals corresponding to said chosen symbols are compared one at a time with the coded signals stored in the symbol comparators so as to produce a coincidence signal each time the stored and chosen signals are the same, the resulting combination of coincidence signals for each chosen signal constituting said occurrence pattern which is stored as a coded signal in the second comparison means. The stored occurrence pattern signal is compared with a predetermined coded occurrence pattern signal associated with said chosen signal and a coincidence signal which serves as a win signal, is produced if said occurrence patterns are the same.

Preferably, each combination of chosen symbol and occurrence pattern has a prize value associated with it which determines the size of prize awarded when the corresponding prize-winning combination occurs.

An embodiment of the invention will now be described by way of example with reference to the accompanying drawing of a block diagram of means according to the invention for detecting prize-winning combinations of symbols in a gaming machine.

The illustrated embodiment is incorporated in gaming machines of the kind having four co-axial independently rotatable reels 1 each of which carries a plurality of symbols around its circumference and can assume any one of a plurality of stop positions in which it displays a corresponding one of the symbols on a payline in a display window so that the reels together display a combination of four symbols on the payline. Detector means 2 is provided for each reel, so as to produce a four bit binary coded signal characteristic of each symbol displayed by the reel on the payline. The detector means may take the form of photoelectric means, rotary switch means or magnetic means.

When the machine is played, the reels are spun and stopped at random under the control of a programmer unit 4 which controls the whole sequence of operations involved in playing a game on the machine. The detector means then produces four coded signals corresponding to the four symbols on the payline and each signal is stored in a corresponding symbol comparator unit 3. An enable signal derived from the programmer unit 4 then triggers an oscillator 5 which clocks a divide by 32 binary counter 6 which in turn drives three PROM (programmed read only memory) units 7, 8 and 9. A first PROM 7 stores four bit binary codes corresponding to the symbols carried on the reels, a second PROM 8 stores four bit binary codes corresponding to symbol occurrence patterns, and the third PROM 9 stores binary codes corresponding to prize values. Each pulse from the binary counter 6 causes the PROMs to deliver a symbol code signal and an occurrence pattern code signal corresponding to a particular prize-winning combination, and an associated prize code signal.

The symbol code signal from PROM 7 is fed to all four symbol comparator units 3 and each produces a coincidence signal (binary 1 signal) if the stored signal and the symbol signal from the PROM are the same, but otherwise produces a zero output signal (binary 0 signal). The resulting output signals from the symbol comparator units 3 are fed to a win comparator 10 and stored therein as a symbol occurrence pattern code. For example, if the first three reels 1 display a Bell symbol and the symbol code signal from the PROM 7 corresponds to a Bell then the symbol comparator units 3 produce the signals 1110 which are stored as a four bit code in the win comparator 10.

Simultaneously with the feeding of the symbol code signal from the first PROM 7 to the symbol comparator units 3, the second PROM 8 feeds an occurrence pattern code signal to the win comparator 10. If this code and the code stored in the win comparator 10 are the same, the latter produces a coincidence signal which enables a presettable counter 11. Thus, for example, if the win comparator 10 stores the signal 1110 as described above, and the second PROM produces a signal 1110, then the win comparator produces a coincidence signal confirming that a prize-winning combination of three Bells on the first three reels is displayed on the payline. Any other code signal from the second PROM fails to produce a coincidence signal from the win comparator.

In the event that the win comparator 10 does not produce a coincidence signal, the oscillator 5 continues to operate and the binary counter 6 drives the PROMs so that they produce the next set of output signals corresponding to another possible prize-winning combination. If, however, the win comparator 10 produces a coincidence signal, the presettable counter 11 is enabled, whereupon it automatically inhibits operation of the oscillator 5 through a connection 12 so that the PROMs do not change their state. At the same time a coin payout unit 13 is enabled and begins to pay out coins one at a time, a counting pulse being produced for each coin paid out.

The prize value code signal from PROM 9 determines the number of coins paid out by the payout unit 13, this signal having set the counter 11 to a corresponding counting state, and the counter being made to count back to zero by the counting pulses from the payout unit 13. When the counter 11 is reset to zero, it inhibits the payout unit 13 to stop the issue of further coins. For example, if the PROMs have been programmed so that ten coins are to be paid out when three Bells occur on the first three reels, then when the Bell code and 1110 code are read from the PROMs 7 and 8, respectively, a prize value code representing ten is read from PROM 9 and sets counter 11 to the ten counting state. Thus, when three Bells do occur on the first three reels, comparator unit 10 produces a win signal which enables counter 11, which in turn enables the payout unit 13. The latter then pays out ten coins and causes counter 11 to count down one for each coin so that issuing of the tenth coin sets the counter 11 to zero. In its zero state counter 11 inhibits the payout unit so no more coins are issued.

Once the counter 11 is reset to zero after completing paying out of a prize, the inhibit signal to the payout unit 13 also passes via connection 12 to enable the oscillator 5. The oscillator then operates to read the next set of codes from the three PROMs 7, 8, 9, these codes corresponding to a different prize winning combination of symbols and an associated prize value.

Preferably, the PROMs are programmed so that they look for the prize-winning combinations with the highest prizes first. It will be appreciated that the reels may display a combination incorporating two prize winning combinations of symbols whereupon both prizes will be issued. For example, a combination such as Bell-Bell-Bell-Cherry may produce one prize corresponding to the three Bells and one corresponding to the Cherry.

In an alternative embodiment of the invention, the PROMs may be replaced by other means, such as magnetic or paper tape units, which can be programmed so as to produce the required sequence of signals.

In another alternative embodiment of the invention, each coded signal stored in the symbol comparator units could include data of the symbols on the payline and also data of the symbols on either side of the payline. This would enable the machine to payout on combinations which include symbols on either side of the payline, these symbols usually being visible in reel type gaming machines.

I claim:

1. Means for detecting prize-winning combinations of symbols in a gaming machine of the kind which selects a combination of symbols at random during each game and awards prizes when predetermined prize-winning combinations occur, said means comprising first memory means for storing information of each of a number of predetermined symbols that can occur in said selected combinations; first comparison means for carrying out succesive first comparison operations in each of which it compares all of the symbols in a selected combination with a respective one of said predetermined symbols stored in said first memory means so as to determine an occurrence pattern for that particular predetermined symbol in said selected combination; second memory means for storing information of each of a number of predetermined symbol occurrence patterns that can occur in said selected combinations; and second comparison means for carrying out successive second comparison operations in each of which it compares one of said occurrence patterns determined by said first comparison means with a respective one of said predetermined occurrence paterns stored in said second memory means that is associated with the predetermined symbol used in the first comparison operation to determine said occurrence pattern and that corresponds to a prize-winning combination, said second comparison means producing a coincidence signal to indicate a win when said determined occurrence pattern corresponds to said predetermined occurrence pattern.

2. Means according to claim 1 including symbol detector means which produces a characteristic coded signal for each symbol in a selected combination.

3. Means according to claim 2 in which said first comparison means comprises a first set of symbol comparator units, in each of which a respective coded signal from the symbol detector means is stored.

4. Means according to claim 3 in which said first memory means produces a characteristic coded signal for each in turn of the predetermined symbols stored therein and feeds this to each of the symbol comparator units in which it is compared with the stored coded signal, each comparator unit producing a coincidence signal when the stored signal and predetermined signal from the first memory means are the same, the resulting combination of coincidence signals from the comparator units corresponding to the determined occurrence pattern.

5. Means according to claim 4 in which the first memory means comprises a first programmable data storage means which is programmed to feed the required coded signal for each predetermined signal to the first set of comparator units in a predetermined sequence.

6. Means according to claim 5 in which the second comparison means comprises a second comparator unit in which the combination of coincidence signals from the symbol comparator units is stored, and in which the second memory means produces a coded signal corresponding to each predetermined occurrence pattern and feeds this to the second comparator unit, the comparator unit comparing the stored and predetermined signals and producing a win coincidence signal when they are the same.

7. Means according to claim 6 in which the second memory means comprises a second programmable data storage means which is programmed to feed the required coded signal for each predetermined occurrence pattern to the second comparator unit in a predetermined sequence.

8. Means according to claim 7 in which clock means controls the supply of coded signals from the first and second data storage means.

9. Means according to claim 8 in which the clock means is triggered by an enable signal each time a symbol is stored in the first set of symbol comparator units.

10. Means according to claim 9 in which the clock means is inhibited by an inhibit signal each time a win coincidence signal is produced.

11. Means according to claim 10 in which said first and second data storage means comprise a number of programmed read only memory units.

12. Means according to claim 8 including prize awarding means which awards a prize when a win coincidence signal is received from the second comparison means, said prize awarding means including a prize value choosing unit in the form of a third programmable data storage means which is programmed to produce a coded signal characteristic of a particular prize value for each combination of predetermined symbol and occurrence pattern, and awarding means which responds to said prize value signal by awarding the corresponding value prize if a win coincidence signal is produced by the second comparison means.

13. Means as claimed in claim 12 in which the clock means controls the supply of coded prize value signals from the third programmable data storage means.

14. Means according to claim 13 in which the clock means is triggered by an enable signal each time a symbol is stored in the first set of symbol comparator units.

15. Means according to claim 13 in which the clock means is inhibited by an inhibit signal each time a win coincidence signal is produced.

16. Means according to claim 15 in which any of said first, second or third data storage means comprises a number of programmed read only memory units.

17. Means according to claim 1 including prize winning awarding means which awards a prize when a win coincidence signal is received from the second comparison means.

18. Means according to claim 17 in which the prize awarding means includes a prize value choosing unit which produces a coded signal characteristic of a particular prize value for each combination of predetermined symbol and occurrence pattern, and awarding means which responds to the prize value signal by awarding the corresponding value prize if a win coincidence signal is produced by the second comparison means.

19. Means according to claim 18 in which the awarding means responsive to the prize value signals comprises a counter which is set in a corresponding counting state by each prize value signal, and a payout pulse generator which is triggered by said coincidence signal from the second comparison means and feeds pulses to the counter causing it to count down to zero, a coin payout operation being initiated by each pulse.

20. Means according to claim 18 in which the prize value choosing unit comprises a third programmable data storage means which is programmed to feed the required coded signal for each predetermined prize value to the awarding means in a predetermined sequence.

21. Means as claimed in claim 20 in which clock means controls the supply of coded prize value signals from the third programmable data storage means.

22. Means for detecting prize-winning combinations of symbols in a gaming machine of the kind which selects a combination of symbols at random during each game and awards prizes when predetermined prize-winning combinations occur, said means comprising detector means for producing a characteristic coded signal for each symbol in a selected combination; first memory means for storing information of each of a number of predetermined symbols that can occur in said selected combination and for producing a sequence of coded signals, each characteristic of one of said predetermined symbols stored therein; a set of first symbol comparator units adapted so that each receives and stores a respective coded signal from the symbol detector means and all receive the same coded signal produced by said first memory means at any one instant and carry out one of a succession of first comparison operations corresponding to said sequence of coded signals from said first memory means, each comparator unit producing a coincidence signal when the two coded signals receives by it are the same, the resulting combination of coincidence signals from the comparator units corresponding to a coded occurrence pattern signal for that particular predetermined symbol associated with the coded signal produced by said first memory means; second memory means for storing information of each of a number of predetermined symbol occurrence that can occur in said selected combination and for producing a sequence of coded signals, each characteristic of one of said predetermined occurrence patterns stored therein; and a second comparator unit adapted to receive each in turn of said coded occurrence pattern signals produced by said first symbol comparator units and to compare each, in one of a succession of second comparison operations, with a number of said coded occurrence pattern signals produced by said second memory means, which coded occurrence pattern signal produced by said second memory means is associated with the predetermined symbol used in the first comparison operation to determine that coded occurrence pattern signal and corresponds to a prize-winning combination, said second comparator unit producing a coincidence signal to indicate a win when the compared coded occurrence pattern signals are the same.

* * * * *